US005270138A

United States Patent [19]

Kaneko et al.

[11] Patent Number: 5,270,138

[45] Date of Patent: Dec. 14, 1993

[54] COLOR IMAGE FORMING METHOD

[75] Inventors: Tadashi Kaneko; Yoshiaki Kobayashi; Shoichi Nakano, all of Hachioji, Japan

[73] Assignee: Konica Corporation, Tokyo, Japan

[21] Appl. No.: 736,551

[22] Filed: Jul. 26, 1991

[30] Foreign Application Priority Data

Jul. 31, 1990 [JP] Japan ..... 2-201182

[51] Int. Cl.[5] ..... G03G 13/01

[52] U.S. Cl. ..... 430/45; 430/42

[58] Field of Search ..... 430/45, 42

[56] References Cited

U.S. PATENT DOCUMENTS 4,093,457 6/1978 Hauser et al. ..... 430/126

5,122,843 6/1992 Yokoyama et al. ..... 430/45 X

*Primary Examiner*—Marion E. McCamish

*Assistant Examiner*—Stephen Crossan

*Attorney, Agent, or Firm*—Finnegan, Henderson, Farabow, Garrett & Dunner

[57] ABSTRACT

A color image forming method by superimposing plural kinds of toner with different colors on a surface of a photoreceptor body is disclosed. The surface of the photoreceptor is uniformly pre-charged with electricity. A kind of toner is selected according to a predetermined order. A latent image corresponding to the selected toner, and consequently corresponding to a selected color, is formed on the surface by a photo-electric exposure. A toner image is formed by developing the latent image with the selected toner. A multiple color image is formed by repeating the above two steps with regard to succeeding colors and kinds of toners until all kinds of toner having been developed. In repeating the development, the following formulas are satisfied under the supposition that (Q/M)n is an amount of electrification of toner used in the n-th development.

$$1.1 = <(Q/M)n/(Q/M)n+1 = <1.5$$

$$1.5 \text{ micro } C/g = <(Q/M)n = <30 \text{ mico } C/g$$

Further, development efficiency is reduced with each subsequent development toner, such that the efficiency of the (n+1)th development is less than the efficiency of the n-th development.

1 Claim, 4 Drawing Sheets

COLOR IMAGE FORMING METHOD

BACKGROUND OF THE INVENTION

The present invention relates to a color image forming method for use in electrophotography, electrostatic recording, electrostatic printing, and similar techniques.

There are known a transfer drum type and photoreceptor body color superimposition type as color image forming methods for electrophotography.

In the transfer drum type, first an electrostatic image on a photoreceptor drum is developed, for example, with a yellow toner, and the developed image is transferred to image carrying material (transfer paper) wound on a transfer drum. Such a process is repeated for yellow, magenta, and cyan toners and a black toner as needed, thereby forming a full color image (see the Japanese Patent Application Laid-Open Nos. 42-23910, 43-24748, 60-76766, and 64-15774.)

However, the transfer drum type electrophotography heretofore used has the following disadvantages.

(1) The apparatus has to be made large as it needs the transfer drum for holding the image carrying material.

(2) A complicated arrangement is needed to hold on or release from the transfer drum the image carrying material.

(3) It is necessary to provide an arrangement and control system to precisely register the photoreceptor body and the transfer drum.

On the other hand, in the photoreceptor drum color superimposition type electrophotography, the color toner images of the yellow, magenta, and cyan toners are superimposed to form the image, and these are all transferred at one time onto image carrying material (transfer paper). The color superimposition type includes a single composition developer type (see the Japanese Patent Application Laid-Open Nos. 1-283574, 2-46474, and 2-55368) and a two composition developer type (see the Japanese Patent Application Laid-Open Nos. 47-27537, 59-58452, and 1-193763). These are desirable in some fields because they need no transfer drum so that the whole apparatus can be made small.

The color superimposition on the photoreceptor body is proceeded as follows.

(1) The whole surface of the photoreceptor body, as shown in FIG. 1(*a*), is uniformly charged to a potential of $-V_H$ (1st charge).

(2) The first color exposure is made as shown in FIG. 1(*b*) (1st exposure). This exposure decreases the surface potential on the photoreceptor body to $V_L$. The potential $V_B$ shown in FIG. 1(*b*) is a bias potential.

(3) The first toner is inversion developed as shown in FIG. 1(*c*) (1st development). This increases the surface potential of the developing portions by the toner layer potential of $-V_1$ due to the negative charge the toner has. That is, the potential of $-V_L$ before the development becomes $-(VL+V1)$ after it.

(4) The whole surface of the photoreceptor body, as shown in FIG. 1(*d*), is uniformly charged for the second color process (2nd charge).

(5) The second color exposure is made for superimposition of the second color as shown in FIG. 1(E) (2nd exposure). This exposure makes the surface potential on the photoreceptor body to $-(V_L+V_1)$ because of the toner layer potential of the first color toner if its light intensity is same as in the 1st exposure.

(6) The second toner is inversion developed as with the first color as shown in FIG. 1(*f*) (2nd development).

This increases the surface potential of the developing section by the toner layer potential of $-V_2$ due to the negative charge the second toner has. That is, the potential of $-(V_L+V_1)$ before the development becomes $-(V_L+V_1+V_2)$ after it.

(7) Similarly, development is made for the third and fourth colors.

(8) If the color toners are all superimposed, then they are all transferred to the image carrying material at one time.

However, the photoreceptor body color superimposition type has the following disadvantages.

The color toner, for example, the yellow toner, developed on the photoreceptor body is charged to negative. This causes the formed toner layer to have a potential of the same polarity as the photoreceptor body. The potential is in proportion to the amount of the toner. With this potential, any of the developed surface portions has the toner layer potential added thereto.

Therefore, if the whole surface of the photoreceptor body is charged again to develop the second color toner, for example, the magenta toner, the surface potential of the photoreceptor is increased at the portions having the yellow toner developed. If the magenta toner is exposed at developing portions, in turn, the surface potential of the photoreceptor body is decreased. As the portions having the preceding yellow toner have higher potential, however, the exposed portions have higher surface potential $V_L$ than the other portions. The potential $V_L$ is high with the amount of the yellow tone applied. That is, the difference of the developing bias contributing to development from $V_1$ ($V_B-V_L$, hereinafter referred to as the development potential) becomes less. If the amount of the yellow toner applied is deviated, that of the following magenta toner applied also is deviated.

On the other hand, to make the superimposition development of the toners, it is optimum to use the non-contact development method, where only the toner to be developed is moved from the developing arrangement to the photoreceptor body while the developer does not contact with the photoreceptor body. However, the non-contact development method has an air layer formed between the developer layer and the photoreceptor body. This will not make the developer layer cause an opposing electrode effect so that the development electric field due to the development potential becomes weaker. This results in an edge effect, where the electric field is enhanced only on the boundary between the exposed portion and non-exposed portion.

As a result, sticking of the toners is concentrated on the edge portions. If the yellow toner is developed first and the magenta toner is developed second to obtain a red image, then the image is adversely affected around its outer edge by the excessive adhesion of the yellow toner, lowering the amount of the magenta toner applied. This is a disadvantageous enhancement of the yellow color in the image.

SUMMARY OF THE INVENTION

In view of the foregoing, it is a general object of the present invention to provide a color image forming method having such a superior color reproducibility that excessive toner development can be suppressed on edges of an electrostatic image and the toners to be developed can also be applied uniformly on the edges, including a color superimposition developing process where a plurality of different color toners are superimposed on a photoreceptor body using a thin layer, non-contact, inversion developing method.

The foregoing object is accomplished in accordance with aspects of the present invention by meeting the following conditions (1) and (2).

Condition (1):

$$1.1 \leqq \frac{(Q/M)_n}{(Q/M)_{n+1}} \leqq 1.5$$

where $(Q/M)_n$ is amount of charge per unit mass of color toner for use in a nth development, provided that $15\ \mu C/g <= Q/M \leqq 30\ \mu C/g$.

Condition (2): Development efficiency in the nth development should be less than that of the (n−1)th development.

With these conditions, the amount of charge $(Q/M)_{n+1}$ of the color toner for use in the (n+1)th development is decreased at a predetermined rate less than that of charge $(Q/M)_n$ of the color toner in the nth development, and the development efficiency also is decreased gradually. This is advantageous in effectively preventing the edge effect.

The term "development efficiently" as used herein denotes a ratio of the toner fed to a development region to the toner developed. It is defined by the following equation.

$$\text{Development efficiency} = \frac{\text{Amount of developing toner per unit area of solid image } (MA)}{\text{Amount of toner supplied to developing region per unit area } (MS)} \times 100\%,$$

where $MS = MT \times VS/VP$, and VS is a line speed of the developing sleeve, VP is a line speed of the photoreceptor body, and MT is a product of the amount of developer per unit area on the developing sleeve by the toner concentration.

As the thin layer, non-contact, inversion development method has a thin developer layer on the developing sleeve, it consumes less amount of toner on the developing sleeve. Its development efficiency therefore is 50 to 100% greater than that of the usual magnetic brush development method. However, it was found that it was effective to decrease this development efficiency in order to prevent the edge effect.

Also, it was found that it was effective to make the amount of charge of the toner larger to accomplish the development with the amount of toner needed for color image forming and to make the development efficiency lower to prevent the edge effect. In other words, it is necessary to set the amount of charge (Q/M) of the color toner in a range of 15 to 30 μC/g.

If the amount of charge is made more than 30 μC/g, the developing sleeve has to be revolved faster to obtain sufficient development. As this results in larger burden on its drive system, it is not practical. It also is not preferable in view of splashing of the developer. If the amount of charge is less than 15 μC/g, the resolution of the image is lowered, and the toner tends to splash.

The inventors further investigated the color superimposition process with respect to the amount of charge of the color toner used. As a result, it was found that the following conditions had to be met depending on the order of development.

If the developments on the photoreceptor body are in order of yellow, magenta, cyan, and black, the amounts of charge (Q/M) of the toners have to the following conditions.

$$1.1 \leqq \frac{(Q/M)\ \text{yellow}}{(Q/M)\ \text{magenta}} \leqq 1.5$$

$$1.1 \leqq \frac{(Q/M)\ \text{magenta}}{(Q/M)\ \text{cyan}} \leqq 1.5$$

$$1.1 \leqq \frac{(Q/M)\ \text{cyan}}{(Q/M)\ \text{black}} \leqq 1.5$$

In short, the amount of charge $(Q/M)_n$ of the toner developed in the nth time has to meet the following condition.

$$1.1 \leqq \frac{(Q/M)_n}{(Q/M)_{n+1}} \leqq 1.5$$

If the amount of charge of the preceding development toner is made less than that of the following one, more development toner applied at the edges suppresses the subsequent toner applied on the portion. This affects color uniformity on solid image portions. It overenhances the color tone of the toner developed first around the edges of the solid portions.

However, it will be particularly understood that the present invention is not limited to the order of development colors.

Also, it is not limitative to use control means available to make the amount of charge (Q/M) of the toner meet the above mentioned conditions. However, it is possible to (1) select binder resins for the toners, (2) select charge control agents for the toners, (3) select additives (flow agents) for the toners, and (4) select surface coating materials for the carrier.

The present invention can use either a single-component developer comprising color toner alone or two-component developer comprising a color toner and a carrier if the color toner can meet the above mentioned conditions.

The color toner is grain powder of the binder resin containing colorant, charge control agent, and fixing improving agent. It may have additional flow agent, such as inorganic particles, mixed therein as necessary. The average grain diameter of the color toner is around 5 to 30 μm as an example.

The binder resin for the toner is not limitative, but can use any of a variety of known resins. If a negative charge toner is used, polyester resin is preferable in view of friction charge order. Secondly, styrene/acrylic resin is preferable. If a positive charge toner is used, styrene/acrylic resin or epoxy resin is preferable.

Also, the colorant for the toner is not limitative, but can be any of the known colorants, such as yellow, magenta, cyan, and black pigments.

Further, the charge control agent for the toner is not limitative, but can use any of known substances. If the negative charge toner is used, complex metal salicylate or the like is preferable. If the positive charge toner is used, nigrosine dye, grade 4 ammonium salt, or the like is preferable.

Further, the fixing improving agent for the toner is preferably polyolefin wax, paraffin wax, ester aliphates and their partial saponificates, aliphatic amide group compounds, or high grade alcohol.

For magnetic toner, the toner grain powder has magnetic substance dispersed therein. The magnetic toner can use any of know magnetic substance.

Any of the toner can have a flow agent mixed thereto as an additive as necessary. For the negative charge toner, the flow agent preferably uses fine silica grains subjected to surface process with dimethyle-dichlsilane, hexamethl-disirazan, or the like. For the positive charge toner, it is preferable to use fine silica grains subjected to surface process with silane coupling agent, silicon oil, or similar agents having amino base.

For the two-component developing agent, a carrier is used together with the toner. The carrier is not limitative, but can be of any known carrier. For combination with the negative charge toner, it is preferable to use a resin coated carrier formed in a way that surfaces of its core grains are coated with a styrene/acrylic resin, such as methyl methacrelate/styrene copolymer. For combination with the positive charge toner, it is preferable to use a resin coated carrier formed in a way that surfaces of its core grains are coated with a fluoroplastic, such as polyfluoride viniliden or tetrafluoroethyrene.

For the core grains, ordinarily a magnetic substance, such as ferrite or magnetite is used.

It is important to make the diameter and magnetization strength of the grains used in proper ranges since in the thin layer, non-contact, inversion development method, thin developing agent layer has to be supplied to the developing region. In view of such a necessity, the average grain diameter of the carrier is preferably 10 to 100 μm, particularly 20 to 60 μm. The magnetization strength of the carrier is preferably 10 to 25 emu/g.

In turn, the following describes the image forming process.

In the developing process, a plurality of different color toners are superimposed on the photoreceptor body in the thin layer, non-contact, inversion developing method to form a multi-color toner image on the photoreceptor body.

First, the photoreceptor is uniformly charged on surface thereof. The photoreceptor is exposed with a color separation light to form an electrostatic image on the photoreceptor. The electrostatic image on the photoreceptor body is inversion developed at a developing region. This is performed by a thin developing agent layer carried by a developing sleeve being transferred in a non-contact state to the photoreceptor body. This process is repeated for the other colors to superimpose the plurality of toner images one by one onto the photoreceptor body to form a multi-toner image on it.

In the developing processes mentioned above, the development order of the color toners is not limitative, but development is ordinarily made in the order of yellow, magenta, cyan, and black.

An exposure light source has to be able to transmit through the toner layer(s) and expose the photoreceptor surface without absorption of the light by the toner layer(s) formed by the development. In view of this necessity, the light is preferably an infrared light of 700 nm wavelength from a semiconductor laser for the yellow, magenta, and cyan colors. In principle, an ultraviolet light can be used, but it is difficult to obtain cheap light source at present.

Thickness of the developing agent layer fed to the developing region has to be thin. That is, as in the non-contact, inversion developing method, a sufficient developing electrostatic field cannot be obtained if a development gap Dsd between the photoreceptor body and the developing sleeve in the developing region is too wide. The gap has to be made narrow; ordinarily 100 to 1000 μm, but preferably 300 to 600 μm. The developing agent layer also has to be made thin so that it cannot directly touch the surface of the photoreceptor body in the developing region. In fact, its average layer thickness has to be 50 to 300 μm preferably 100 to 200 μm thinner than the development gap Dsd.

It is preferable that the developing region has an oscillating electromagnetic field formed therein. The oscillating electromagnetic field is not necessarily needed, but it is effective to enhance reproducibility of thin lines. In view of suppression of the edge effect, however, the oscillating electromagnetic field is preferably made rather weak. Its frequency should be 1 to 10 kHz, preferably 4 to 8 kHz, and its voltage should be 0.5 to 3 kVp-p, preferably 1.0 to 2.0 kVp-p.

The developing sleeve has a magnet assembly having a plurality of poles provided therein. Their magnetic forces carry the developing agent layer (magnetic brush) onto the developing sleeve.

The thickness of the thin developing agent layer formed on the developing sleeve can be controlled with use of a proper arrangement. This can be accomplished, as an example, by a plate-like thickness restriction member having elasticity is elastically pressed to the surface of the developing sleeve to make the developing agent pass between the thickness restriction member and the developing sleeve.

If the developing process is completed, then this is moved to a transfer process. In the transfer process, the multiple of color toner images on the photoreceptor body are all transferred to transfer material, such as paper, at one time. For the transference, either of an electrostatic transfer method or bias transfer method may be used, although the electrostatic transfer method is particularly preferable. In this method, for example, a transfer arrangement capable of dc corona discharge is positioned to face the photoreceptor via the transfer material. The dc corona discharge is applied to a rear side of the transfer material, thereby transferring the multi-color toner image from the surface of the photoreceptor body onto the surface of the transfer material at one time. In the earlier stage of the transfer process, charging and/or exposure may be made to make the transference easy.

If the transfer process is completed, cleaning is made in a way that the toner remaining after the transference is removed from the photoreceptor body. Cleaning arrangement is not limitative, but it is preferable to use a blade method, where a cleaning blade is brought in contact with the surface of the photoreceptor. With the cleaning blade made to slide on the surface of the photoreceptor, the remaining toner is wiped off. In the earlier stage of the cleaning process, it is preferable to discharge the surface of the photoreceptor to make cleaning easy. For this, for example, a discharger capable of ac corona discharge is used.

On the other hand, the transfer material having the multi-color toner image transferred thereto may be heated and fixed or pressed and fixed in a fixing process to form a fixed multi-color image.

BRIEF DESCRIPTION OF THE DRAWINGS

Other objects and advantages of the present invention will further become apparent hereinafter and in the drawings in which.

DETAILED DESCRIPTION OF THE PREFERRED EMBODIMENTS

Figure 1A:
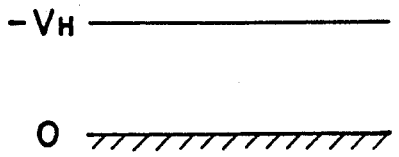
FIGS. 1(*e*) through 1(*f*) are sequential illustrations of a color superimposition process on a photoreceptor body.
Figure 1B:
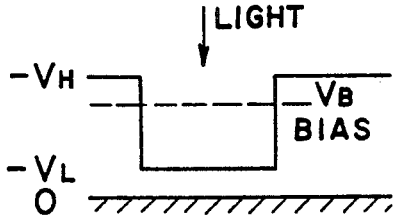
Figure 1C:
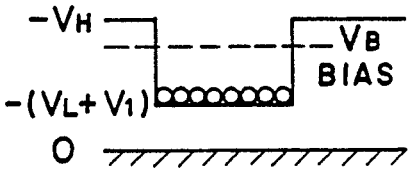
Figure 1D:
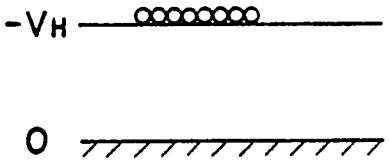
Figure 1E:
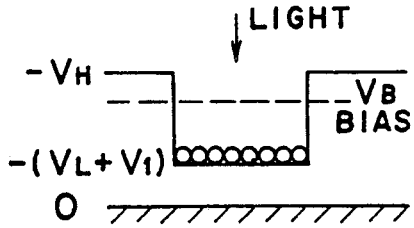
Figure 1F:
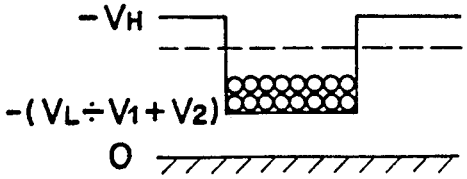
Figure 2:
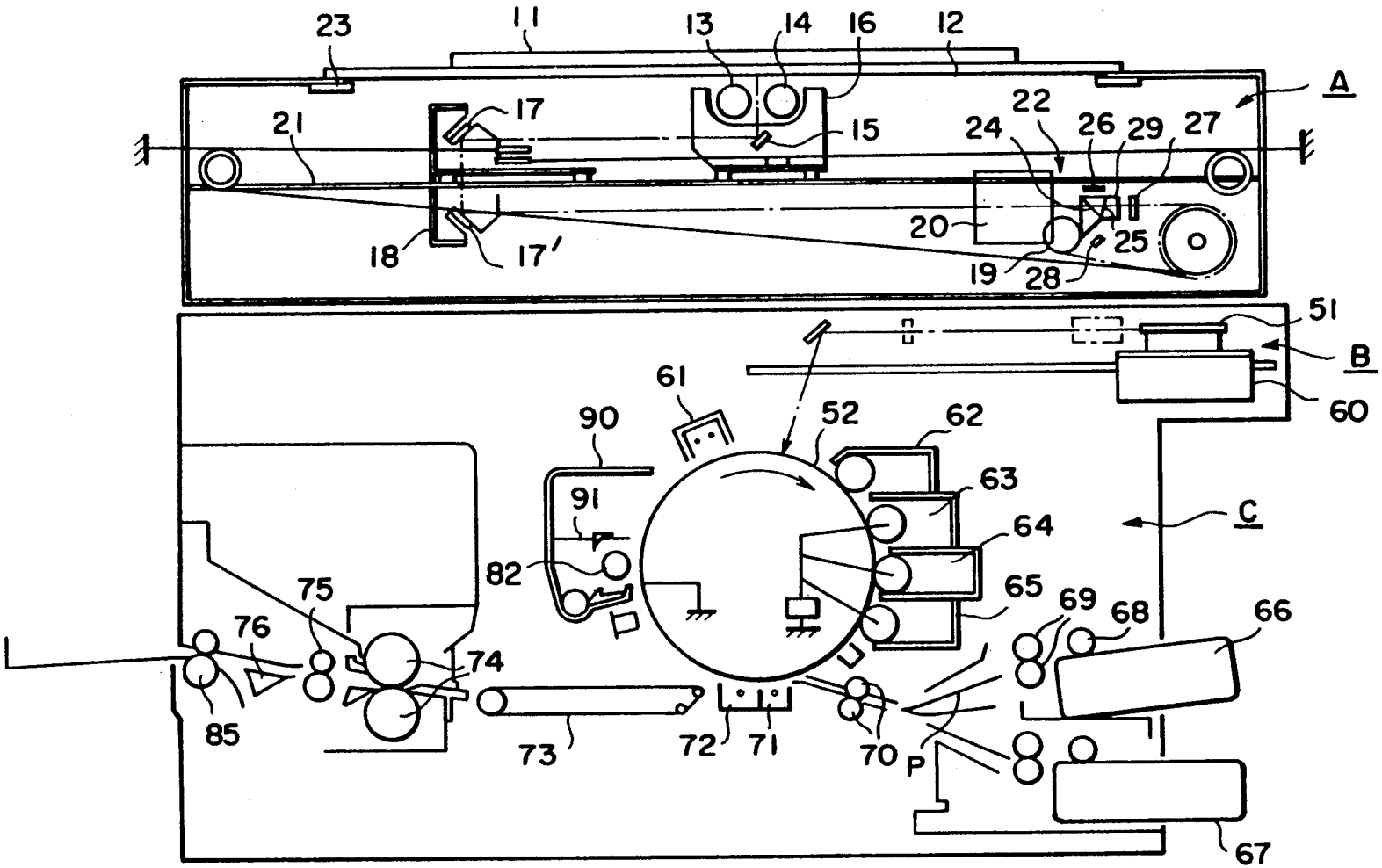
FIG. 2 is a cross sectional view of an illustrative example of a color image forming apparatus for use in an embodiment of the present invention.
Figure 3:
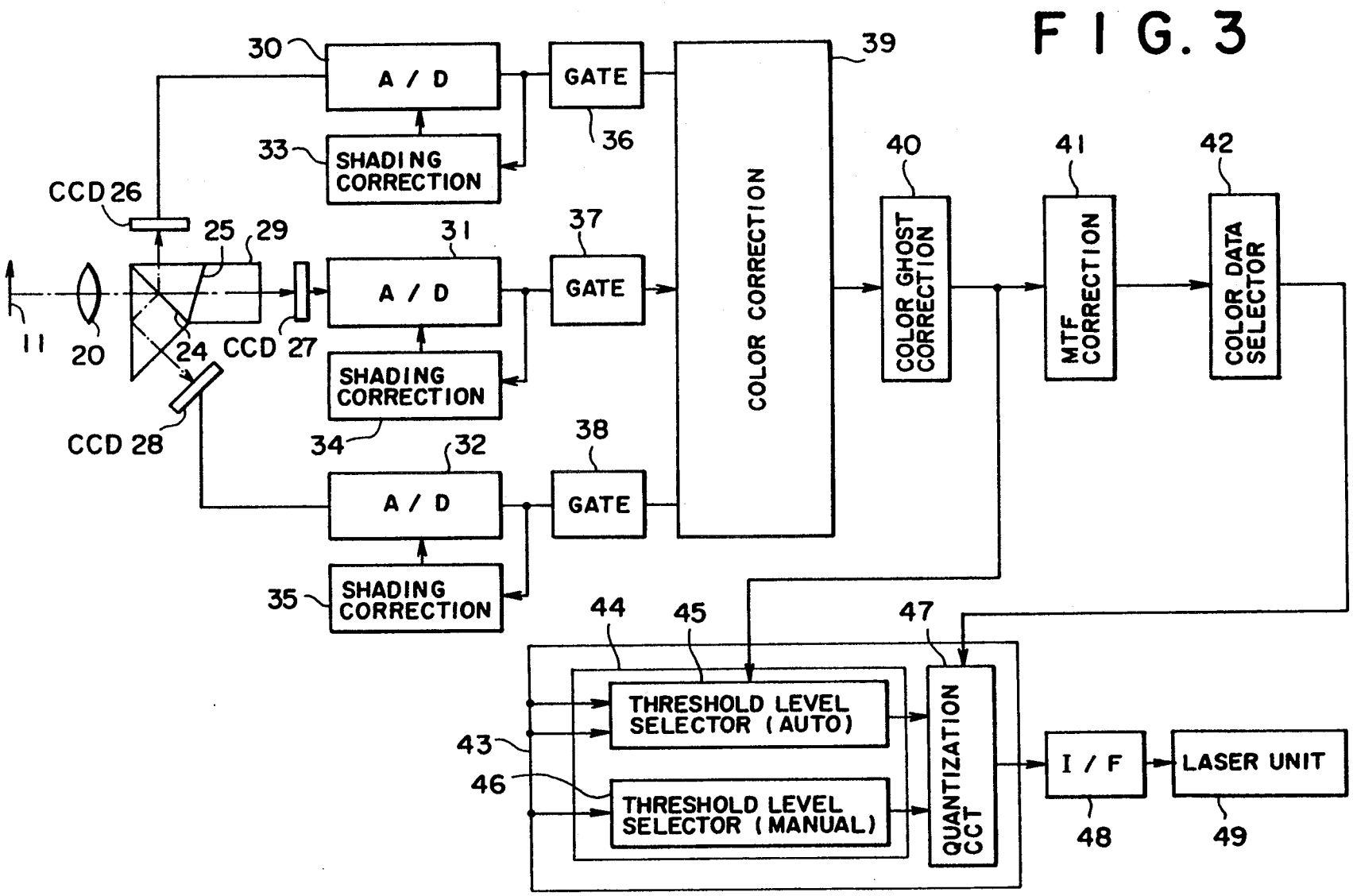
FIG. 3 is a block diagram for a signal system for reading a color document.
Figure 4:
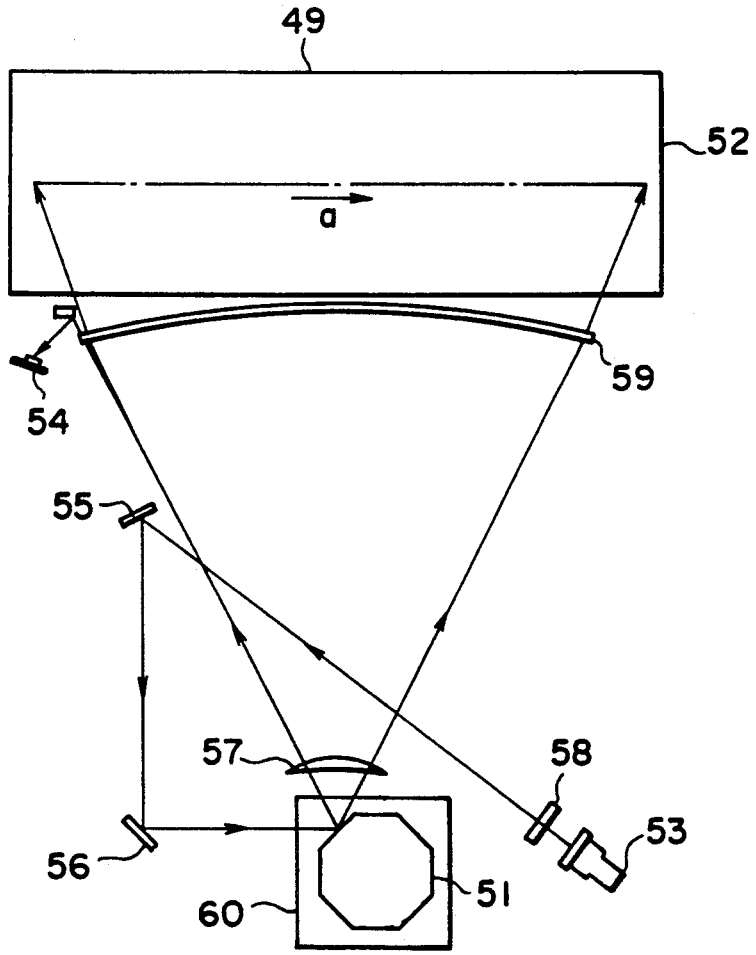
FIG. 4 is an illustration for a semiconductor laser optical apparatus.

The present invention is illustrated in further detail by reference to the accompanying drawings in which: FIG. 2 is a cross sectional view of an illustrative example of a color image forming apparatus for use in an embodiment of the present invention. FIG. 3 is a block diagram for a signal system for reading a color document. FIG. 4 is an illustration for a semiconductor laser optical apparatus.

FIG. 2 shows a document table 12 on which a color document 11 is scanned by an optical system. The optical system comprises a carriage 16 having fluorescent lamps 13 and 14 and a reflection mirror 15 provided thereon, and a movable mirror unit 18 having V mirror 17 and 17′ provided therein. The carriage 16 and movable mirror unit 18 can be moved on a slide rail 21 at a predetermined speed in a predetermined direction by a stepping motor 19.

Optical information (image information) obtained by irradiating the color document 11 by the fluorescent lamps 13 and 14 is led to an optical information conversion unit 22 through the reflection mirror 15 and the V mirror 17 and 17′. The fluorescent lamps 13 and 14 used are soft white fluorescent lamps available on the market to prevent specific color enhancement and attenuation on the basis of optics in scanning a color document. They are lit and driven by an rf power of around 40 kHz to prevent flicker. They are heated by a heater having a thermistor to keep their wall temperature constant or to promote warm-up.

The document table 12 has a standard white plate 23 provided at its left side on an inside thereof. The standard white plate 23 is optically scanned to normalize image signals to white.

The optical information conversion unit 22 comprises a lens 20, a prism 29, two dichroic mirrors 24 and 25, a CCD 26 for providing a red separated image, a CCD 27 for providing a green separated image, and a CCD 28 for providing a blue separated image. The optical signal obtained through the optical system is concentrated through the lens 20, and is color separated into blue and yellow optical informations by the dichroic mirror 24 provided in the prism 29. The yellow optical information is further color separated into red and green optical information by the dichroic mirror 25. In this manner, the color optical image is separated into three color information, red R, green G, blue B, by the prism 29.

Each of the separated color images are focused on the respective CCDs, which convert them to image signals. The image signals are properly processed through a signal processing system to color record signals, yellow Y, magenta M, cyan C, and black Bk. The color, record signals are fed to a write section B individually.

The operations described above are made by a color document read section A. FIG. 3 is a block diagram for a color processing system.

That is, as described above, the color image information of the color document 11 is color separated into the three colors, red R, green G, and blue B, by the two dichroic mirrors 24 and 25. For the purpose, a cutoff wavelength of the dichroic mirror 24 is around 450 to 520 nm, and that of the dichroic mirror 25 is around 550 to 620 nm. Therefore, the green component is made a transmitting light, the blue component is a first reflecting light, and the red component is a second reflecting light.

The separated color images, red R, green G, and blue B, are fed to image read arrangements, such as CCDs 26, 27, and 28. These CCD sensors feed out the respective image signals of the red, green, and blue components alone.

The image signals R, G, and B are fed to A-D converters 30, 31, and 32. These convert the image signals to digital signals of predetermined number of bits, such as eight bits in the example. At the same time of the A-D conversion, the image signals are corrected in shadings by shading corrections circuits 33, 34, and 35. Each of the shading correction circuits corrects distortion due to image exposure with use of the white signal obtained by scanning the standard white plate 23 as reference signal. This corrects for any nonhomogenous lengthwise amount of light from the light source lamp.

From each of the shading corrected digital image signals is extracted only a signal portion of a maximum document size through gates 36, 37, and 38, which is fed to a next stage of a color correction circuit 39. If the maximum document size is size A3, for example, a size signal A3 generated by a timing signal forming arrangement (not shown) is used as a gate signal.

As for the shading corrected digital image signals VR, VG, and VB fed to the color correction circuit 39, these are converted to color signals for use in an image output apparatus.

Colors of the image output apparatus shown include yellow Y, magenta M, cyan C, and black Bk.

Each of the converted color signals includes color code data of two bits for indicating color information and concentration data of six bits. The data of the color signals used, for example, are the ones stored in a correction map in a ROM.

The color corrected image data is moved to a color image processing stage. First, the color coue data is fed to a next stage of a color ghost correction circuit 40. The color ghost correction circuit 40 corrects the data with pixels of $7\times1$ in a main scanning direction (horizontal scanning direction) and with pixels of $1\times7$ in a subscanning direction (drum revolving direction) to correct for color ghost.

The correction is needed as unnecessary color ghosts occurs around characters, particularly around black characters at the time of color correction. Depending on the layout of the color correction map, red or blue color typically appear around edges of the black characters. With elimination of the color ghost, the image can be improved. The color ghost process is made for the color code data only.

The concentration data is corrected for resolution by an MTF correction circuit 41 as the resolution correction is a contour correction.

A color data selector circuit 42 has a process command signal for selecting an image process input from a display and operation panel thereto. It also has Y, M, C, and Bk signals for indicating the colors to be provided and output currently thereto. With these signals and the above mentioned input signals, it is determined whether the resolution corrected concentration data is sent to the next stage of quantizing section 43.

If copying is made alone, for example, only images of the same colors as the Y, M, C, and Bk signals are fed out. That is, for color conversion on the whole document, as an example, if magenta is color converted to cyan and cyan to magenta, control is made so that the magenta image data can be fed out at the time of recording the cyan, and the cyan image data can be fed out at the time of recording the magenta.

The image data (concentration data) output of the color data selector circuit 42 is quantized by a quantizing section 43. In the example, the concentration data of 6 bits are converted to two bit data of 0 to 3 (4-value data). Threshold data (of six bits) as reference for the 4-value quantization are to be set manually or automatically.

For the quantization, a threshold selection circuit 44 has a manual threshold determination stage 46 for manual setting of the threshold data and an automatic threshold determination stage 45 for automatic setting. The manual threshold determination stage 46 can have an independent threshold value determined by color external to feed out. The threshold value is used for two-value quantization. The automatic threshold determination stage 45 is formed of a ROM having predetermined threshold values stored therein. Selection of the manual or automatic mode is made by an EE reset signal. The threshold selection circuit 44 is ordinarily set in the automatic mode (EE mode). It also has the Y, M, C, and Bk signals fed thereto to select a particular color in a current sequence.

The image data quantized to four values by the quantizing section 43 are fed through an interface circuit 48 to the write section B.

The signal processings of the read signal system A described so far were disclosed in detail in the Japanese Patent Application No. 63-16413 filed by the applicant.

The write section B used is made up of a semiconductor laser arrangement 49 shown in FIG. 4. Laser beam is modulated by the four-value recording signal from the read signal system A, is converted to predetermined optical signal, and is written on photoreceptor body 52.

The semiconductor laser arrangement 49 has a laser oscillator 53 which generates the laser beam. The laser beam is irradiated through mirrors 55 and 56 to a deflector 51 comprising an eight-face revolving mirror (polygon). The polygon deflects the laser beam to irradiate a surface of the photoreceptor body 52 through a f-$\theta$ lens 57. The f-$\theta$ lens 57 is provided to make the laser beam to a predetermined diameter on the photoreceptor body 52.

Cylindrical lenses 58 and 59 are provided for correction of leaning angle.

The laser beam can be scanned at a fixed speed in a predetermined direction a by the deflector 51 revolved at a fixed speed by a drive motor 60. The scanning allows image exposure corresponding to the record signal by color.

The deflector 51 can be made up of a galvanic mirror. Alternatively, an optical crystal deflector, or the like, may be used. With start of the deflection scanning by the laser beam, the beam scanning is detected by a laser beam index sensor 54, then the first color record signal (yellow Y signal) starts modulation of the beam. The modulated beam is made to scan the photoreceptor body 52, which is charged uniformly by a charger 61.

With the main scanning by the laser beam and the subscanning by the revolution of the photoreceptor body 52, the photoreceptor body 52 has an electrostatic image corresponding to the first color signal Y formed thereon. The electrostatic image is developed in a thin layer, non-contact, inversion developing method by a first developing arrangement 62 containing yellow developer to form a yellow toner image.

Similarly, a second color record signal (magenta signal) is obtained the read signal system A, and the photoreceptor drum 52 is recharged by the charger 61. The magenta signal is beam scanned, and a magenta toner image is developed by a second developing arrangement 63 containing magenta developer and is superimposed on the yellow image.

Likewise, a third color record signal (cyan signal) is used for writing and development by a third developing arrangement 64 (cyan developing arrangement), and a forth color record signal (black signal) is used for writing and development by a fourth developing arrangement 65 (black developing arrangement). This process forms a multi-color toner image on the photoreceptor body 52.

The multi-color toner image is then transferred at one time by a transfer electrode 71 onto transfer paper P fed from a paper feed cassette 66 through a paper feed roller 68, a carrying roller 69, and a timing roller 70. The transfer paper P having the multi-color toner image is separated by action of a separation electrode 72 and is carried to a fixing arrangement 74 by a carrying belt 73 to fix the toner on the paper. The fixed paper is discharged to a discharge tray by a discharge roller 85.

EXAMPLES

For the purpose of illustration only, the present invention will now be illustrated by the following examples. Of course, the present invention shall not be limited to the following examples. A term "part" in the following example denotes the "weight part".

<Binder resin A>

| | |
|---|---|
| Polyoxypylene (2.2)-2, 2-bis (4-hydroxyphenyl) propane | 700 g. |
| Boletic acid | 150 g. |
| n-dodecenyl anhydrous succinic acid | 55.4 g. |
| Hydrokinone | 0.1 g. |

The chemicals mentioned above were put in a round-bottom flask of 1 liter capacity having a thermometer, a stainless steel stirrer, a glass nitrogen gas feed pipe, and a drop condenser provided therein. The flask was set in a mantle heater. Nitrogen gas was supplied from the nitrogen gas feed pipe. Temperature inside the flask was raised to 250° C., with the inactive atmosphere maintained. In these conditions, the chemicals were made to react while they were stirred. A resulted acid value of 1.5 was measured when no water was generated with the reaction.

Further, anhydrous 1, 2, 4-benzene tricarboxylic acid of 65.4 g was added, and reaction was made for around eight hours until the acid value became 20. A squatting temperature of the polyester resin obtained in such a ring and ball method (according to the JIS K 2531-1960) was 130° C. The polyester resin was use as binder resin A here.

<Binder resin B>

| | |
|---|---|
| Polyoxypylene (2)-2, 2-bis (4-hydroxyphenyl) propane | 650 g. |
| Boletic acid | 120 g. |
| n-dodecenyl anhydrous succinic acid | 55.4 g. |

The chemicals mentioned above were reacted with use of the same devices as in the binder resin A at 220° C. A resulted acid value of 1.5 it was measured when no water was generated with the reaction. Further, anhydrous 1, 2, 4-benzene tricarboxylic acid of 79 g was added, and reaction was made at 200° C. The squatting temperature of the polyester resin obtained in the ring and ball method was 135° C. The polyester resin was use as binder resin B here.

<Yellow toner A>

| | |
|---|---|
| Binder resin A | 100 parts. |
| Polypropyrene (Biscoal 550P, Sanyo Kasei Kogyo Co.) | 4 parts. |
| Yellow pigment (Ket-Yellow 406, Dainippon Ink Kagaku Kogyo Co.) | 4 parts. |

The chemicals prepared above were subjected to usual process, including mixing, melting, crushing, and classifying, to obtain yellow powder of average grain diameter of 11 μm.

100 parts of yellow powder had colloidal silica (R-972, Nippon Earosil Co.) of 0.4 part added thereto, and was dispersed and mixed by a henshell mixer to obtain the yellow toner A.

<Magenta toner A>

The magenta toner A was obtained using the same process as in the preparation of the yellow toner A except that the yellow pigment was replaced by 4 parts of magenta pigment (Ket-Red 310, Dainippon Ink Kagaku Kogyo Co.).

<Cyan toner A>

The cyan toner A was obtained using the same process as in the preparation of the yellow toner A except that the yellow pigment was replaced by 2 parts of cyan pigment (Ket-Blue 104, Dainippon Ink Kagaku Kogyo Co.).

<Yellow toner B>

| | |
|---|---|
| Binder resin B | 100 parts. |
| Polypropyrene (Biscoal 660P, Sanyo Kasei Kogyo Co.) | 4 parts. |
| Yellow pigment (Hostaperm Yellow GR-80, Hexit Co.) | 4 parts. |

The chemicals prepared above were subjected to the same process as in the preparation of the yellow toner A to obtain the yellow toner B.

<Magenta toner B>

The magenta toner B was obtained using the same process as in the preparation of the yellow toner B except that the yellow pigment was replaced by 2 parts of magenta pigment (Hostaperm Pink E02, Hexit Co.).

<Cyan toner B>

The cyan toner B was obtained using the same process as in the preparation of the yellow toner B except that the yellow pigment was replaced by 2 parts of cyan pigment (Heliogen Blue D7 080, BASF Co.).

<Carrier A>

Copper-magnesium group ferrite grains having a magnetization of 20 emu/g, a particle size of 20 to 74 μm, and an average grain diameter of 44 μm, had toluene solution of methyl methacrylate/styrene copolymer (copolymer ratio of 8 to 2 and molecular weight of 130,000) sprayed to surfaces thereof to obtain a coating carrier having a coating layer on surfaces thereof. Amount of the coating layer was made 2 weight % of the ferrite. The coating carrier obtained was used as carrier A.

<Carrier B>

The carrier B was obtained using the same process as in the preparation of the carrier A except that the copolymer was replaced by methyl methacrylate/styrene copolymer (copolymer ratio of 6 to 4 and molecular weight of 150,000).

<Carrier C>

The carrier C was obtained in the same process as in the preparation of the carrier A except that the copolymer was replaced by methyl methacrylate/styrene copolymer (copolymer ratio of 4 to 6 and molecular weight of 145,000).

EXAMPLE 1

The color developers were prepared with toner of 40 g and carrier of 360 g mixed in combinations shown in Table 1 below.

TABLE 1

| DEVELOPER | TONER | CARRIER |
|---|---|---|
| Yellow developer 1 | Yellow toner A | Carrier A |
| Red developer 1 | Magenta toner A | Carrier B |
| Blue developer 1 | Cyan toner A | Carrier C |

The inventors made the copying test at a temperature of 20° C. and relative humidity of 60% in a developing process that a plurality of different color toners were superimposed one after another in the thin layer, non-contact, inversion developing method. The inventors used an improved type of the electrophotographic copying machine, Konica 8010, Konica Co., Ltd., in which the laser write system was improved to make superimposition exposure possible. In the test, an exposure potential VL of −100 V, a dc bias of −750 V, an ac bias of 1.6 kVp-p, and a frequency of 8 kHz were used.

Also, the inventors measured charges (Q/M) of the color toners using a charge measuring instrument, the Ease Part Analyzer, Hosokawa Micron Co. The results are shown in Table 2. Revolution speeds of the developing sleeves were set as given in Table 3.

Further, the inventors measured amounts of the developing toners needed for solid images on the photoreceptor body. They obtained development efficiencies using the following equation. The results are shown in Tables 2 and 3.

$$\text{Development efficiency} = \frac{\text{Amount of developing toner per unit area of solid image } (MA)}{\text{Amount of toner supplied to developing region per unit area } (MS)} \times 100\%,$$

where MS=MT×VS/VP, and where VS is a line speed of the developing sleeve, VP is a line speed of the photoreceptor body, and MT is a product of the amount of developer per unit area on the developing sleeve by the toner concentration.

TABLE 2

| DEVELOPER | Q/M | AMOUNT OF SOLID DEVELOPER |
|---|---|---|
| Yellow developer 1 | −25 μC/g | 0.62 mg/cm² |
| Red developer 1 | −20 μC/g | 0.81 mg/cm² |
| Blue developer 1 | −18 μC/g | 0.79 mg/cm² |

TABLE 3

| DEVELOPER | REVOLUTION SPEED OF DEVELOPING SLEEVE | DEVELOPMENT EFFICIENCY |
|---|---|---|
| Yellow developer 1 | 430 rpm | 54.8% |
| Red developer 1 | 380 rpm | 81.0% |
| Blue developer 1 | 350 rpm | 85.8% |

The inventors examined the color reproduction of the fixed print image obtained in the copying test. Results are shown in Table 4.

In the table, Y denotes the yellow developer, M is the red developer, and C is the blue developer. Y+M+C, as an example, indicates that the yellow, red, and blue developers were used to develop in this order. The image 1 is a patch image of 1 by 2 cm, and the image 2 is a line image of 1 mm wide.

TABLE 4

| TYPE OF SUPER-IMPOSITION | BASIC REPRO-DUCTION COLOR | IMAGE 1 EDGES | IMAGE 1 CENTER | IMAGE 2 COLOR TONE |
|---|---|---|---|---|
| Y + M + C | Black | Black | Black | Black |
| Y + M | Red | Red | Red | Red |
| M + C | Blue | Blue | Blue | Blue |
| Y + C | Green | Green | Green | Green |

EXAMPLE 2

The color developers were prepared with toner of 40 g and carrier of 60 g mixed in combinations shown in Table 5 below.

TABLE 5

| DEVELOPER | TONER | CARRIER |
|---|---|---|
| Yellow developer 2 | Yellow toner B | Carrier A |
| Red developer 2 | Magenta toner B | Carrier B |
| Blue developer 2 | Cyan toner B | Carrier C |

Evaluation was made in the same way as in Example 1. Results were shown in Tables 6 through 8.

TABLE 6

| DEVELOPER | Q/M | AMOUNT OF SOLID DEVELOPER |
|---|---|---|
| Yellow developer 2 | −24 μC/g | 0.67 mg/cm² |
| Red developer 2 | −19 μC/g | 0.83 mg/cm² |
| Blue developer 2 | −16 μC/g | 0.81 mg/cm² |

TABLE 7

| DEVELOPER | REVOLUTION SPEED OF DEVELOPING SLEEVE | DEVELOPMENT EFFICIENCY |
|---|---|---|
| Yellow developer 2 | 410 rpm | 62.1% |
| Red developer 2 | 370 rpm | 85.2% |
| Blue developer 2 | 330 rpm | 93.3% |

TABLE 8

| TYPE OF SUPER-IMPOSITION | BASIC REPRO-DUCTION COLOR | IMAGE 1 EDGES | IMAGE 1 CENTER | IMAGE 2 COLOR TONE |
|---|---|---|---|---|
| Y + M + C | Black | Black | Black | Black |
| Y + M | Red | Red | Red | Red |
| M + C | Blue | Blue | Blue | Blue |
| Y + C | Green | Green | Green | Green |

EXAMPLE 3

The color developers were prepared with toner of 40 g and carrier of 60 g mixed in combinations shown in Table 9 below.

TABLE 9

| DEVELOPER | TONER | CARRIER |
|---|---|---|
| Yellow developer 3 | Yellow toner B | Carrier A |
| Red developer 3 | Magenta toner B | Carrier A |
| Blue developer 3 | Cyan toner A | Carrier B |

Evaluation was made in the same way as in Example 1. Results were shown in Tables 10 through 12.

TABLE 10

| DEVELOPER | Q/M | AMOUNT OF SOLID DEVELOPER |
|---|---|---|
| Yellow developer 3 | −27 μC/g | 0.66 mg/cm² |
| Red developer 3 | −23 μC/g | 0.83 mg/cm² |
| Blue developer 3 | −18 μC/g | 0.81 mg/cm² |

TABLE 11

| DEVELOPER | REVOLUTION SPEED OF DEVELOPING SLEEVE | DEVELOPMENT EFFICIENCY |
|---|---|---|
| Yellow developer 3 | 470 rpm | 53.4% |
| Red developer 3 | 370 rpm | 85.2% |
| Blue developer 3 | 330 rpm | 93.3% |

TABLE 12

| TYPE OF SUPER-IMPOSITION | BASIC REPRO-DUCTION COLOR | IMAGE 1 EDGES | IMAGE 1 CENTER | IMAGE 2 COLOR TONE |
|---|---|---|---|---|
| Y + M + C | Black | Black | Black | Black |
| Y + M | Red | Red | Red | Red |

TABLE 12-continued

| TYPE OF SUPER-IMPOSITION | BASIC REPRO-DUCTION COLOR | IMAGE 1 EDGES | IMAGE 1 CENTER | IMAGE 2 COLOR TONE |
|---|---|---|---|---|
| M + C | Blue | Blue | Blue | Blue |
| Y + C | Green | Green | Green | Green |

COMPARISON 1

The color developers were prepared with toner of 40 g and carrier of 60 g mixed in combinations shown in Table 13 below.

TABLE 13

| DEVELOPER | TONER | CARRIER |
|---|---|---|
| Yellow developer 4 | Yellow toner A | Carrier B |
| Red developer 4 | Magenta toner B | Carrier A |
| Blue developer 4 | Cyan toner C | Carrier A |

Evaluation was made in the same way as in Example 1. Results were shown in Tables 14 through 16.

TABLE 14

| DEVELOPER | Q/M | AMOUNT OF SOLID DEVELOPER |
|---|---|---|
| Yellow developer 4 | −18 μC/g | 0.67 mg/cm$^2$ |
| Red developer 4 | −25 μC/g | 0.82 mg/cm$^2$ |
| Blue developer 4 | −27 μC/g | 0.82 mg/cm$^2$ |

TABLE 15

| DEVELOPER | REVOLUTION SPEED OF DEVELOPING SLEEVE | DEVELOPMENT EFFICIENCY |
|---|---|---|
| Yellow developer 4 | 320 rpm | 79.6% |
| Red developer 4 | 400 rpm | 77.9% |
| Blue developer 4 | 450 rpm | 69.2% |

TABLE 16

| TYPE OF SUPER-IMPOSITION | BASIC REPRO-DUCTION COLOR | IMAGE 1 EDGES | IMAGE 1 CENTER | IMAGE 2 COLOR TONE |
|---|---|---|---|---|
| Y + M + C | Black | Yellow | Black | Yellow |
| Y + M | Red | Yellow | Red | Yellow |
| M + C | Blue | Magenta | Blue | Magenta |
| Y + C | Green | Cyan | Green | Cyan |

As can be seen from Table 16, adhesion of the second color toner developed at the edges and thin line portions is suppressed by excessive adhesion of the first color toner so that the color reproduction is worse.

COMPARISON 2

The color developers were prepared with toner of 40 g and carrier of 60 g mixed in combinations shown in Table 17 below.

TABLE 17

| DEVELOPER | TONER | CARRIER |
|---|---|---|
| Yellow developer 5 | Yellow toner B | Carrier C |
| Red developer 5 | Magenta toner B | Carrier C |
| Blue developer 5 | Cyan toner B | Carrier C |

Evaluation was made in the same way as in Example 1. Results were shown in Tables 18 through 20.

TABLE 18

| DEVELOPER | Q/M | AMOUNT OF SOLID DEVELOPER |
|---|---|---|
| Yellow developer 5 | −14 μC/g | 0.65 mg/cm$^2$ |
| Red developer 5 | −15 μC/g | 0.85 mg/cm$^2$ |
| Blue developer 5 | −16 μC/g | 0.82 mg/cm$^2$ |

TABLE 19

| DEVELOPER | REVOLUTION SPEED OF DEVELOPING SLEEVE | DEVELOPMENT EFFICIENCY |
|---|---|---|
| Yellow developer 5 | 320 rpm | 77.2% |
| Red developer 5 | 350 rpm | 92.3% |
| Blue developer 5 | 350 rpm | 89.1% |

TABLE 20

| TYPE OF SUPER-IMPOSITION | BASIC REPRO-DUCTION COLOR | IMAGE 1 EDGES | IMAGE 1 CENTER | IMAGE 2 COLOR TONE |
|---|---|---|---|---|
| Y + M + C | Black | Yellow | Black | Yellow |
| Y + M | Red | Yellow | Red | Yellow |
| M + C | Blue | Magenta | Blue | Magenta |
| Y + C | Green | Cyan | Green | Cyan |

As can be seen from Table 20, adhesion of the second color toner developed at the edges and thin line portions is suppressed by excessive adhesion of the first color toner so that the color reproduction is worse.

ADVANTAGE OF THE INVENTION

The advantages of the present invention consist in particular in the fact that the amount of charge $(Q/M)_{n+1}$ of the color toner for use in the (n+1)th development is decreased at a predetermined rate less than that of charge $(Q/M)_n$ of the color toner in the nth development, and the development efficiency also is decreased gradually. This is advantageous in effectively preventing the edge effect, thus assuring of forming color images having superior color reproducibility.

What is claimed is:

1. A color image forming method in which a superimposed image is formed on a surface of a photoreceptor body by sequential superposition of plural kinds of toner in a predetermined order from a first kind of toner to a last kind of toner, each kind of toner having a different color from each other kind of toner and being used in a development of a toner image by means of a thin layer, non-contact inversion development technique, the method comprising the steps of:

(1) selecting a kind of toner for development in accordance with the predetermined order, the selected kind of toner being recognized as the n-th kind of toner;

(2) charging the selected kind of toner with an electrostatic charge;

(3) charging the surface of the photoreceptor body to a uniform electric potential;

(4) forming an electrostatic latent image on the surface of the photoreceptor body corresponding to the selected kind of toner;

(5) developing the electrostatic latent image using the selected kind of toner to form a toner image using the selected kind of toner;

(6) repeating the steps (1) to (4) for a subsequent kind of toner recognized as a (N+1)th kind of toner until the last kind of toner of the predetermined order has been selected and developed under a condition that the following formulas are satisfied:

$$15 \text{ micro } C/g = < (Q/M)n = < 30 \text{ micro } C/g,$$

$$1.1 = < (Q/M)n/(Q/M)n+1 = < 1.5,$$

and (developing efficiency)$n+1$ < (developing efficiency)$n$, wherein (Q/M)n is defined as an amount of electrostatic charge per unit mass of the n-th kind of toner charged for the development, (Q/M)n+1 is defined as an amount of electrostatic charge per unit mass of the (n+1)th kind of toner subsequently charged for the development, (developing efficiency)n is an amount of n-th kind of toner developed per unit area in a solid image divided by an amount of n-th kind of toner supplied from a corresponding developing unit, and (developing efficiency)n+1 is an amount of (n+1)th kind of toner developed per unit area in a solid image divided by an amount of (n+1)th kind of toner supplied from a corresponding developing unit; and (7) transferring the toner image superimposed on the surface of the photoreceptor body to a copy sheet.

* * * * *

UNITED STATES PATENT AND TRADEMARK OFFICE

CERTIFICATE OF CORRECTION

PATENT NO. : 5,270,138

DATED : December 14, 1993

INVENTOR(S) : Tadashi Kaneko et al.

It is certified that error appears in the above-indentified patent and that said Letters Patent is hereby corrected as shown below:

Abstract, title page in the equation, line 2, change "1.5" to --15--.

Abstract, title page in the equation, line 2, change "mico" to --micro--.

*Claim 1, column 17, line 5, change "(N+1)th" to --(n+1)th--.

Signed and Sealed this

Thirteenth Day of September, 1994

Bruce Lehman

*Attest:*

BRUCE LEHMAN

*Attesting Officer*

*Commissioner of Patents and Trademarks*